US009275783B2

(12) United States Patent
Fullerton et al.

(10) Patent No.: US 9,275,783 B2
(45) Date of Patent: Mar. 1, 2016

(54) SYSTEM AND METHOD FOR DEMAGNETIZATION OF A MAGNETIC STRUCTURE REGION

(71) Applicant: Correlated Magnetics Research, LLC., New Hope, AL (US)

(72) Inventors: Larry W. Fullerton, New Hope, AL (US); Mark D. Roberts, Huntsville, AL (US); Hamilton Grant Moore, Decatur, AL (US)

(73) Assignee: CORRELATED MAGNETICS RESEARCH, LLC., New Hope, AL (US)

( * ) Notice: Subject to any disclaimer, the term of this patent is extended or adjusted under 35 U.S.C. 154(b) by 158 days.

(21) Appl. No.: 14/052,891

(22) Filed: Oct. 14, 2013

(65) Prior Publication Data

US 2014/0104021 A1 Apr. 17, 2014

Related U.S. Application Data

(60) Provisional application No. 61/795,352, filed on Oct. 15, 2012.

(51) Int. Cl.
*H01F 13/00* (2006.01)

(52) U.S. Cl.
CPC ..... *H01F 13/006* (2013.01)

(58) Field of Classification Search
CPC ..... H01F 13/00; H01F 7/20; H01F 27/2847
USPC ..... 336/223, 232; 335/284–295, 299
See application file for complete search history.

(56) References Cited

U.S. PATENT DOCUMENTS

| | | | |
|---|---|---|---|
| 93,931 | A | 8/1869 | Westcott |
| 342,666 | A | 5/1886 | Williams |
| 361,248 | A | 4/1887 | Winton |
| 400,809 | A | 4/1889 | Van Depoele |
| 405,109 | A | 5/1889 | Williams |
| 450,543 | A | 4/1891 | Van Depoele |
| 493,858 | A | 3/1893 | Edison |
| 675,323 | A | 5/1901 | Clark |

(Continued)

FOREIGN PATENT DOCUMENTS

| | | | |
|---|---|---|---|
| CN | 1615573 | A | 5/2005 |
| DE | 2938782 | A1 | 4/1981 |

(Continued)

OTHER PUBLICATIONS

United States Office Action issued in U.S. Appl. No. 13/470,994 dated Aug. 8, 2013.

(Continued)

*Primary Examiner* — Mohamad Musleh
(74) *Attorney, Agent, or Firm* — William J. Tucker

(57) ABSTRACT

A system and a method are described herein for demagnetizing a region of a magnetic structure. In one embodiment, the system comprises: (a) a pulsed magnetizer; and (b) at least one magnetizing coil that receives a sequence of discrete current with continually decreasing current values from the pulsed magnetizer and outputs a sequence of discrete magnetizing fields with continually decreasing field strengths to overwrite and at least partly demagnetize the region of the magnetic structure. The at least one magnetizing coil is located adjacent to the region of the magnetic structure.

22 Claims, 6 Drawing Sheets

(56) References Cited

U.S. PATENT DOCUMENTS

| | | | | |
|---|---|---|---|---|
| 687,292 | A | | 11/1901 | Armstrong |
| 996,933 | A | | 7/1911 | Lindquist |
| 1,024,418 | A | | 4/1912 | Podlesak |
| 1,081,462 | A | | 12/1913 | Patton |
| 1,171,351 | A | | 2/1916 | Neuland |
| 1,180,489 | A | | 4/1916 | Geist |
| 1,184,056 | A | | 5/1916 | Deventer |
| 1,236,234 | A | | 8/1917 | Troje |
| 1,252,289 | A | | 1/1918 | Murray, Jr. |
| 1,290,190 | A | | 1/1919 | Herrick |
| 1,301,135 | A | | 4/1919 | Karasick |
| 1,307,342 | A | | 6/1919 | Brown |
| 1,312,546 | A | | 8/1919 | Karasick |
| 1,323,546 | A | | 8/1919 | Karasick |
| 1,554,236 | A | | 1/1920 | Simmons |
| 1,343,751 | A | | 6/1920 | Simmons |
| 1,544,010 | A | | 6/1925 | Jordan |
| 1,554,254 | A | | 9/1925 | Zbinden |
| 1,624,741 | A | | 12/1926 | Leppke et al. |
| 1,784,256 | A | | 12/1930 | Stout |
| 1,785,643 | A | | 12/1930 | Noack et al. |
| 1,823,326 | A | | 9/1931 | Legg |
| 1,895,129 | A | | 1/1933 | Jones |
| 1,975,175 | A | | 10/1934 | Scofield |
| 2,048,161 | A | | 7/1936 | Klaiber |
| 2,058,339 | A | | 10/1936 | Metzger |
| 2,147,482 | A | | 12/1936 | Butler |
| 2,111,643 | A | | 3/1938 | Salvatori |
| 2,130,213 | A | | 9/1938 | Wolf et al. |
| 2,158,132 | A | | 5/1939 | Legg |
| 2,186,074 | A | | 1/1940 | Koller |
| 2,240,035 | A | | 4/1941 | Catherall |
| 2,243,555 | A | | 5/1941 | Faus |
| 2,245,268 | A | | 6/1941 | Goss et al. |
| 2,269,149 | A | | 1/1942 | Edgar |
| 2,286,897 | A | | 6/1942 | Costa et al. |
| 2,296,754 | A | | 9/1942 | Wolf et al. |
| 2,315,045 | A | | 3/1943 | Breitenstein |
| 2,316,616 | A | | 4/1943 | Powell |
| 2,327,748 | A | | 8/1943 | Smith |
| 2,337,248 | A | | 12/1943 | Koller |
| 2,337,249 | A | | 12/1943 | Koller |
| 2,362,151 | A | | 11/1944 | Ostenberg |
| 2,389,298 | A | | 11/1945 | Ellis |
| 2,401,887 | A | | 6/1946 | Sheppard |
| 2,409,857 | A | | 10/1946 | Hines et al. |
| 2,414,653 | A | | 1/1947 | Lokholder |
| 2,426,322 | A | | 8/1947 | Pridham |
| 2,438,231 | A | | 3/1948 | Shultz |
| 2,471,634 | A | | 5/1949 | Vennice |
| 2,472,127 | A | | 6/1949 | Slason |
| 2,475,200 | A | | 7/1949 | Roys |
| 2,475,456 | A | | 7/1949 | Norlander |
| 2,483,895 | A | | 10/1949 | Fisher |
| 2,508,305 | A | | 5/1950 | Teetor |
| 2,513,226 | A | | 6/1950 | Wylie |
| 2,514,927 | A | | 7/1950 | Bernhard |
| 2,520,828 | A | | 8/1950 | Bertschi |
| 2,540,796 | A | | 2/1951 | Stanton |
| 2,544,077 | A | | 3/1951 | Gardner |
| 2,565,624 | A | | 8/1951 | Phelon |
| 2,570,625 | A | | 10/1951 | Zimmerman et al. |
| 2,640,955 | A | | 6/1953 | Fisher |
| 2,690,349 | A | | 9/1954 | Teetor |
| 2,694,164 | A | | 11/1954 | Geppelt |
| 2,694,613 | A | | 11/1954 | Williams |
| 2,701,158 | A | | 2/1955 | Schmitt |
| 2,722,617 | A | | 11/1955 | Cluwen et al. |
| 2,740,946 | A | | 4/1956 | Geneslay |
| 2,770,759 | A | | 11/1956 | Ahlgren |
| 2,787,719 | A | | 4/1957 | Thomas |
| 2,820,411 | A | | 1/1958 | Park |
| 2,825,863 | A | | 3/1958 | Krupen |
| 2,837,366 | A | | 6/1958 | Loeb |
| 2,842,688 | A | | 7/1958 | Martin |
| 2,853,331 | A | | 9/1958 | Teetor |
| 2,888,291 | A | | 5/1959 | Scott et al. |
| 2,896,991 | A | | 7/1959 | Martin, Jr. |
| 2,897,417 | A | * | 7/1959 | MacDonough et al. ..... 335/284 |
| 2,900,592 | A | | 8/1959 | Baruch |
| 2,935,352 | A | | 5/1960 | Heppner |
| 2,935,353 | A | | 5/1960 | Loeb |
| 2,936,437 | A | | 5/1960 | Fraser et al. |
| 2,959,747 | A | | 11/1960 | Challacombe et al. |
| 2,962,318 | A | | 11/1960 | Teetor |
| 3,024,374 | A | | 3/1962 | Stauder |
| 3,055,999 | A | | 9/1962 | Lucas |
| 3,089,986 | A | | 5/1963 | Gauthier |
| 3,100,292 | A | | 8/1963 | Warner, Jr. et al. |
| 3,102,205 | A | | 8/1963 | Combs |
| 3,102,314 | A | | 9/1963 | Alderfer |
| 3,105,153 | A | | 9/1963 | James, Jr. |
| 3,149,255 | A | | 9/1964 | Trench |
| 3,151,902 | A | | 10/1964 | Ahlgren |
| 3,204,995 | A | | 9/1965 | Teetor |
| 3,208,296 | A | | 9/1965 | Baermann |
| 3,238,399 | A | | 3/1966 | Johanees et al. |
| 3,273,104 | A | | 9/1966 | Krol |
| 3,288,511 | A | | 11/1966 | Tavano |
| 3,296,471 | A | * | 1/1967 | Cochardt ..... 310/154.46 |
| 3,301,091 | A | | 1/1967 | Reese |
| 3,303,398 | A | * | 2/1967 | Barta et al. ..... 361/148 |
| 3,351,368 | A | | 11/1967 | Sweet |
| 3,382,386 | A | | 5/1968 | Schlaeppi |
| 3,408,104 | A | | 10/1968 | Raynes |
| 3,414,309 | A | | 12/1968 | Tresemer |
| 3,425,729 | A | | 2/1969 | Bisbing |
| 2,932,545 | A | | 4/1969 | Foley |
| 3,468,576 | A | | 9/1969 | Beyer et al. |
| 3,474,366 | A | | 10/1969 | Barney |
| 3,496,871 | A | | 2/1970 | Stengel |
| 3,500,090 | A | | 3/1970 | Baermann |
| 3,521,216 | A | | 7/1970 | Tolegian |
| 3,645,650 | A | | 2/1972 | Laing |
| 3,668,670 | A | | 6/1972 | Andersen |
| 3,684,992 | A | | 8/1972 | Huguet et al. |
| 3,690,393 | A | | 9/1972 | Guy |
| 3,696,251 | A | | 10/1972 | Last et al. |
| 3,696,258 | A | | 10/1972 | Anderson et al. |
| 3,707,924 | A | | 1/1973 | Barthalon et al. |
| 3,790,197 | A | | 2/1974 | Parker |
| 3,791,309 | A | | 2/1974 | Baermann |
| 3,802,034 | A | | 4/1974 | Bookless |
| 3,803,433 | A | | 4/1974 | Ingenito |
| 3,808,577 | A | | 4/1974 | Mathauser |
| 3,836,801 | A | | 9/1974 | Yamashita et al. |
| 3,845,430 | A | | 10/1974 | Petkewicz et al. |
| 3,893,059 | A | | 7/1975 | Nowak |
| 3,976,316 | A | | 8/1976 | Laby |
| 4,079,558 | A | | 3/1978 | Forham |
| 4,114,305 | A | | 9/1978 | Wohlert et al. |
| 4,115,040 | A | | 9/1978 | Knorr |
| 4,117,431 | A | | 9/1978 | Eicher |
| 4,129,187 | A | | 12/1978 | Wengryn et al. |
| 4,129,846 | A | | 12/1978 | Yablochnikov |
| 4,140,932 | A | | 2/1979 | Wohlert |
| 4,209,905 | A | | 7/1980 | Gillings |
| 4,222,489 | A | | 9/1980 | Hutter |
| 4,232,535 | A | | 11/1980 | Caldwell |
| 4,296,394 | A | | 10/1981 | Ragheb |
| 4,340,833 | A | | 7/1982 | Sudo et al. |
| 4,352,960 | A | | 10/1982 | Dormer et al. |
| 4,354,218 | A | * | 10/1982 | Steingroever et al. ..... 361/147 |
| 4,359,765 | A | * | 11/1982 | Mimura et al. ..... 361/147 |
| 4,363,980 | A | | 12/1982 | Petersen |
| 4,399,595 | A | | 8/1983 | Yoon et al. |
| 4,416,127 | A | | 11/1983 | Naveda |
| 4,421,118 | A | | 12/1983 | Dow et al. |
| 4,451,811 | A | | 5/1984 | Hoffman |
| 4,453,294 | A | | 6/1984 | Morita |
| 4,454,426 | A | | 6/1984 | Benson |
| 4,460,855 | A | | 7/1984 | Kelly |
| 4,500,827 | A | | 2/1985 | Merritt et al. |
| 4,517,483 | A | | 5/1985 | Hucker et al. |

(56) References Cited

U.S. PATENT DOCUMENTS 4,535,278 A 8/1985 Asakawa
4,547,756 A 10/1985 Miller et al.
4,629,131 A 12/1986 Podell
4,645,283 A 2/1987 MacDonald et al.
4,649,925 A 3/1987 Dow et al.
4,680,494 A 7/1987 Grosjean
4,767,378 A 8/1988 Obermann
4,785,816 A 11/1988 Dow et al.
4,808,955 A 2/1989 Godkin et al.
4,814,654 A 3/1989 Gerfast
4,837,539 A 6/1989 Baker
4,849,749 A 7/1989 Fukamachi et al.
4,856,631 A 8/1989 Okamoto et al.
4,912,727 A 3/1990 Schubert
4,920,326 A * 4/1990 Agarwala ..... 335/284
4,924,123 A 5/1990 Hamajima et al.
4,941,236 A 7/1990 Sherman et al.
4,954,800 A * 9/1990 Ohtsuka ..... 335/284
4,956,625 A 9/1990 Cardone et al.
4,980,593 A 12/1990 Edmundson
4,993,950 A 2/1991 Mensor, Jr.
4,996,457 A 2/1991 Hawsey et al.
5,013,949 A 5/1991 Mabe, Jr.
5,020,625 A 6/1991 Yamauchi et al.
5,050,276 A 9/1991 Pemberton
5,062,855 A 11/1991 Rincoe
5,123,843 A 6/1992 Van der Zel et al.
5,139,383 A 8/1992 Polyak et al.
5,179,307 A 1/1993 Porter
5,190,325 A 3/1993 Doss-Desouza
5,302,929 A 4/1994 Kovacs
5,309,680 A 5/1994 Kiel
5,345,207 A 9/1994 Gebele
5,347,186 A 9/1994 Konotchick
5,349,258 A 9/1994 Leupold et al.
5,367,891 A 11/1994 Furuyama
5,383,049 A 1/1995 Carr
5,384,957 A * 1/1995 Mohri et al. ..... 29/895.32
5,838,304 A 1/1995 Car
5,394,132 A 2/1995 Poil
5,396,140 A 3/1995 Goldie et al.
5,425,763 A 6/1995 Stemmann
5,434,549 A 7/1995 Hirabayashi et al.
5,440,997 A 8/1995 Crowley
5,452,663 A 9/1995 Berdut
5,461,386 A 10/1995 Knebelkamp
5,475,283 A * 12/1995 Yoshida ..... 315/8
5,485,435 A 1/1996 Matsuda et al.
5,492,572 A 2/1996 Schroeder et al.
5,495,221 A 2/1996 Post
5,512,732 A 4/1996 Yagnik et al.
5,570,084 A 10/1996 Ritter et al.
5,582,522 A 12/1996 Johnson
5,602,527 A * 2/1997 Suenaga ..... 340/551
5,604,960 A 2/1997 Good
5,631,093 A 5/1997 Perry et al.
5,631,618 A 5/1997 Trumper et al.
5,633,555 A 5/1997 Ackermann et al.
5,635,889 A 6/1997 Stelter
5,637,972 A 6/1997 Randall et al.
5,650,681 A 7/1997 DeLerno
5,730,155 A 3/1998 Allen
5,759,054 A 6/1998 Spadafore
5,788,493 A 8/1998 Tanaka et al.
5,789,878 A 8/1998 Kroeker et al.
5,818,132 A 10/1998 Konotchick
5,852,393 A 12/1998 Reznik et al.
5,902,185 A 5/1999 Kubiak et al.
5,921,357 A 7/1999 Starkovich et al.
5,935,155 A 8/1999 Humayun et al.
5,956,778 A 9/1999 Godoy
5,975,714 A 11/1999 Vetorino et al.
5,983,406 A 11/1999 Meyerrose
5,988,336 A 11/1999 Wendt et al.
5,995,358 A 11/1999 Buisson
6,000,484 A 12/1999 Zoretich et al.
6,039,759 A 3/2000 Carpentier et al.
6,040,642 A 3/2000 Ishiyama
6,047,456 A 4/2000 Yao et al.
6,070,038 A * 5/2000 Imamura et al. ..... 399/277
6,072,251 A 6/2000 Markle
6,074,420 A 6/2000 Eaton
6,104,108 A 8/2000 Hazelton et al.
6,115,849 A 9/2000 Meyerrose
6,118,271 A 9/2000 Ely et al.
6,120,283 A 9/2000 Cousins
6,125,955 A 10/2000 Zoretich et al.
6,142,779 A 11/2000 Siegel et al.
6,157,100 A 12/2000 Mielke
6,170,131 B1 1/2001 Shin
6,181,110 B1 1/2001 Lampis
6,187,041 B1 2/2001 Garonzik
6,188,147 B1 2/2001 Hazelton et al.
6,205,012 B1 3/2001 Lear
6,210,033 B1 4/2001 Karkos, Jr. et al.
6,224,374 B1 5/2001 Mayo
6,234,833 B1 5/2001 Tsai et al.
6,273,918 B1 8/2001 Yuhasz et al.
6,275,778 B1 8/2001 Shimada et al.
6,285,097 B1 9/2001 Hazelton et al.
6,313,551 B1 11/2001 Hazelton
6,313,552 B1 11/2001 Boast
6,387,096 B1 5/2002 Hyde, Jr.
6,422,533 B1 7/2002 Harms
6,457,179 B1 10/2002 Prendergast
6,467,326 B1 10/2002 Garrigus
6,478,681 B1 11/2002 Overaker et al.
6,517,560 B1 2/2003 Toth et al.
6,540,515 B1 4/2003 Tanaka
6,561,815 B1 5/2003 Schmidt
6,599,321 B2 7/2003 Hyde, Jr.
6,607,304 B1 8/2003 Lake et al.
6,608,540 B1 8/2003 Hones et al.
6,652,278 B2 11/2003 Honkura et al.
6,653,919 B2 11/2003 Shih-Chung et al.
6,720,698 B2 4/2004 Galbraith
6,747,537 B1 6/2004 Mosteller
6,768,230 B2 7/2004 Cheung et al.
6,821,126 B2 11/2004 Neidlein
6,841,910 B2 1/2005 Gery
6,842,332 B1 1/2005 Rubenson et al.
6,847,134 B2 1/2005 Frissen et al.
6,850,139 B1 2/2005 Dettmann et al.
6,862,748 B2 3/2005 Prendergast
6,913,471 B2 7/2005 Smith
6,927,657 B1 8/2005 Wu
6,936,937 B2 8/2005 Tu et al.
6,950,279 B2 9/2005 Sasaki et al.
6,952,060 B2 10/2005 Goldner et al.
6,954,938 B2 10/2005 Emberty et al.
6,954,968 B1 10/2005 Sitbon
6,971,147 B2 12/2005 Halstead
7,009,874 B2 3/2006 Deak
7,016,492 B2 3/2006 Pan et al.
7,031,160 B2 4/2006 Tillotson
7,033,400 B2 4/2006 Currier
7,065,860 B2 6/2006 Aoki et al.
7,066,739 B2 6/2006 McLeish
7,066,778 B2 6/2006 Kretzschmar
7,097,461 B2 8/2006 Neidlein
7,101,374 B2 9/2006 Hyde, Jr.
7,134,452 B2 11/2006 Hiroshi et al.
7,135,792 B2 11/2006 Devaney et al.
7,137,727 B2 11/2006 Joseph et al.
7,186,265 B2 3/2007 Sharkawy et al.
7,224,252 B2 5/2007 Meadow, Jr. et al.
7,264,479 B1 9/2007 Lee
7,276,025 B2 10/2007 Roberts et al.
7,309,934 B2 12/2007 Tu et al.
7,311,526 B2 12/2007 Rohrbach et al.
7,339,790 B2 3/2008 Baker et al.
7,344,380 B2 3/2008 Neidlein et al.
7,351,066 B2 4/2008 DiFonzo et al.
7,358,724 B2 4/2008 Taylor et al.

(56) References Cited

U.S. PATENT DOCUMENTS 7,362,018 B1 4/2008 Kulogo et al.
7,364,433 B2 4/2008 Neidlein
7,381,181 B2 6/2008 Lau et al.
7,402,175 B2 7/2008 Azar
7,416,414 B2 8/2008 Bozzone et al.
7,438,726 B2 10/2008 Erb
7,444,683 B2 11/2008 Prendergast et al.
7,453,341 B1 11/2008 Hildenbrand
7,467,948 B2 12/2008 Lindberg et al.
7,498,914 B2 3/2009 Miyashita et al.
7,583,500 B2 9/2009 Ligtenberg et al.
7,628,173 B2 12/2009 Rosko et al.
7,637,746 B2 12/2009 Lindberg et al.
7,645,143 B2 1/2010 Rohrbach et al.
7,658,613 B1 2/2010 Griffin et al.
7,688,036 B2 3/2010 Yarger et al.
7,762,817 B2 7/2010 Ligtenberg et al.
7,775,567 B2 8/2010 Ligtenberg et al.
7,796,002 B2 9/2010 Hashimoto et al.
7,799,281 B2 9/2010 Cook et al.
7,808,349 B2 10/2010 Fullerton et al.
7,812,697 B2 10/2010 Fullerton et al.
7,817,004 B2 10/2010 Fullerton et al.
7,828,556 B2 11/2010 Rodrigues
7,832,897 B2 11/2010 Ku
7,837,032 B2 11/2010 Smeltzer
7,839,246 B2 11/2010 Fullerton et al.
7,843,297 B2 11/2010 Fullerton et al.
7,868,721 B2 1/2011 Fullerton et al.
7,871,272 B2 1/2011 Firman, II et al.
7,874,856 B1 1/2011 Schriefer et al.
7,901,216 B2 3/2011 Rohrbach et al.
7,903,397 B2 3/2011 McCoy
7,905,626 B2 3/2011 Shantha et al.
7,980,268 B2 7/2011 Rosko et al.
7,997,906 B2 8/2011 Ligtenberg et al.
8,002,585 B2 8/2011 Zhou
8,004,792 B2 8/2011 Biskeborn et al.
8,009,001 B1 8/2011 Cleveland
8,050,714 B2 11/2011 Fadell et al.
8,078,224 B2 12/2011 Fadell et al.
8,078,776 B2 12/2011 Novotney et al.
8,087,939 B2 1/2012 Rohrbach et al.
8,138,868 B2 3/2012 Arnold
8,138,869 B1 3/2012 Lauder et al.
8,143,982 B1 3/2012 Lauder et al.
8,143,983 B1 3/2012 Lauder et al.
8,165,634 B2 4/2012 Fadell et al.
8,177,560 B2 5/2012 Rohrbach et al.
8,187,006 B2 5/2012 Rudisill et al.
8,190,205 B2 5/2012 Fadell et al.
8,242,868 B2 8/2012 Lauder et al.
8,253,518 B2 8/2012 Lauder et al.
8,264,310 B2 9/2012 Lauder et al.
8,264,314 B2 9/2012 Sankar
8,271,038 B2 9/2012 Fadell et al.
8,271,705 B2 9/2012 Novotney et al.
8,297,367 B2 10/2012 Chen et al.
8,344,836 B2 1/2013 Lauder et al.
8,348,678 B2 1/2013 Hardisty et al.
8,354,767 B2 1/2013 Pennander et al.
8,390,411 B2 3/2013 Lauder et al.
8,390,412 B2 3/2013 Lauder et al.
8,390,413 B2 3/2013 Lauder et al.
8,395,465 B2 3/2013 Lauder et al.
8,398,409 B2 3/2013 Schmidt
8,435,042 B2 5/2013 Rohrbach et al.
8,454,372 B2 6/2013 Lee
8,467,829 B2 6/2013 Fadell et al.
8,497,753 B2 7/2013 DiFonzo et al.
8,514,042 B2 8/2013 Lauder et al.
8,535,088 B2 9/2013 Gao et al.
8,576,031 B2 11/2013 Lauder et al.
8,576,034 B2 11/2013 Bilbrey et al.
8,586,410 B2 11/2013 Arnold et al.
8,616,362 B1 12/2013 Browne et al.
8,648,679 B2 2/2014 Lauder et al.
8,665,044 B2 3/2014 Lauder et al.
8,665,045 B2 3/2014 Lauder et al.
8,690,582 B2 4/2014 Rohrbach et al.
8,702,316 B2 4/2014 DiFonzo et al.
8,734,024 B2 5/2014 Isenhour et al.
8,752,200 B2 6/2014 Varshavsky et al.
8,757,893 B1 6/2014 Isenhour et al.
8,770,857 B2 7/2014 DiFonzo et al.
8,774,577 B2 7/2014 Benjamin et al.
8,781,273 B2 7/2014 Benjamin et al.
2002/0125977 A1 9/2002 VanZoest
2003/0170976 A1 9/2003 Molla et al.
2003/0179880 A1 9/2003 Pan et al.
2003/0187510 A1 10/2003 Hyde
2004/0003487 A1 1/2004 Reiter
2004/0155748 A1 8/2004 Steingroever
2004/0244636 A1 12/2004 Meadow et al.
2004/0251759 A1 12/2004 Hirzel
2005/0102802 A1 5/2005 Sitbon et al.
2005/0196484 A1 9/2005 Khoshnevis
2005/0231046 A1 10/2005 Aoshima
2005/0240263 A1 10/2005 Fogarty et al.
2005/0263549 A1 12/2005 Scheiner
2006/0066428 A1 3/2006 McCarthy et al.
2006/0111191 A1 5/2006 Wise
2006/0189259 A1 8/2006 Park et al.
2006/0198047 A1 9/2006 Xue et al.
2006/0214756 A1 9/2006 Elliott et al.
2006/0290451 A1 12/2006 Prendergast et al.
2006/0293762 A1 12/2006 Schulman et al.
2007/0072476 A1 3/2007 Milan
2007/0075594 A1 4/2007 Sadler
2007/0103266 A1 5/2007 Wang et al.
2007/0138806 A1 6/2007 Ligtenberg et al.
2007/0255400 A1 11/2007 Parravicini et al.
2007/0267929 A1 11/2007 Pulnikov et al.
2008/0139261 A1 6/2008 Cho et al.
2008/0181804 A1 7/2008 Tanigawa et al.
2008/0186683 A1 8/2008 Ligtenberg et al.
2008/0218299 A1 9/2008 Arnold
2008/0224806 A1 9/2008 Ogden et al.
2008/0272868 A1 11/2008 Prendergast et al.
2008/0282517 A1 11/2008 Claro
2009/0021333 A1 1/2009 Fiedler
2009/0058201 A1 3/2009 Brennvall
2009/0091195 A1 4/2009 Hyde et al.
2009/0146508 A1 6/2009 Peng et al.
2009/0209173 A1 8/2009 Arledge et al.
2009/0230786 A1 9/2009 Liu
2009/0250576 A1 10/2009 Fullerton et al.
2009/0251256 A1 10/2009 Fullerton et al.
2009/0254196 A1 10/2009 Cox et al.
2009/0273422 A1* 11/2009 Fullerton et al. ..... 335/306
2009/0278642 A1 11/2009 Fullerton et al.
2009/0289090 A1 11/2009 Fullerton et al.
2009/0289749 A1 11/2009 Fullerton et al.
2009/0292371 A1 11/2009 Fullerton et al.
2010/0033280 A1 2/2010 Bird et al.
2010/0084928 A1 4/2010 Yoshida et al.
2010/0126857 A1 5/2010 Polwart et al.
2010/0167576 A1 7/2010 Zhou
2011/0026203 A1 2/2011 Ligtenberg et al.
2011/0037545 A1* 2/2011 Sivasubramaniam et al. ..... 335/216
2011/0210636 A1 9/2011 Kuhlmann-Wilsdorf
2011/0234344 A1 9/2011 Fullerton et al.
2011/0248806 A1 10/2011 Michael
2011/0279206 A1 11/2011 Fullerton et al.
2012/0007704 A1 1/2012 Nerl
2012/0085753 A1 4/2012 Fitch et al.
2012/0235519 A1 9/2012 Dyer et al.
2012/0262261 A1 10/2012 Sarai
2013/0001745 A1 1/2013 Lehmann et al
2013/0186209 A1 7/2013 Herbst
2013/0186473 A1 7/2013 Mankame et al.
2013/0186807 A1 7/2013 Browne et al.
2013/0187538 A1 7/2013 Herbst

(56) References Cited

U.S. PATENT DOCUMENTS

| | | | |
|---|---|---|---|
| 2013/0192860 | A1 | 8/2013 | Puzio et al. |
| 2013/0207758 | A1 | 8/2013 | Browne et al. |
| 2013/0252375 | A1 | 9/2013 | Yi et al. |
| 2013/0256274 | A1 | 10/2013 | Faulkner |
| 2013/0279060 | A1 | 10/2013 | Nehl |
| 2013/0305705 | A1 | 11/2013 | Ac et al. |
| 2013/0341137 | A1 | 12/2013 | Mandame et al. |
| 2014/0044972 | A1 | 2/2014 | Menassa et al. |
| 2014/0072261 | A1 | 4/2014 | Isenhour et al. |
| 2014/0152252 | A1 | 6/2014 | Wood et al. |
| 2014/0205235 | A1 | 7/2014 | Benjamin et al. |
| 2014/0221741 | A1 | 8/2014 | Wang et al. |

FOREIGN PATENT DOCUMENTS

| | | | |
|---|---|---|---|
| EP | 0 345 554 | A1 | 12/1989 |
| EP | 0 545 737 | A1 | 6/1993 |
| FR | 823395 | | 1/1938 |
| GB | 1 495 677 | A | 12/1977 |
| JP | 60-091011 | U | 5/1985 |
| WO | WO-02/31945 | A2 | 4/2002 |
| WO | WO-2007/081830 | A2 | 7/2007 |
| WO | WO-2009/124030 | A1 | 10/2009 |
| WO | WO-2010/141324 | A1 | 12/2010 |

OTHER PUBLICATIONS

United States Office Action issued in U.S. Appl. No. 13/430,219 dated Aug. 13, 2013.

Series BNS, Compatible Series AES Safety Controllers, http://www.schmersalusa.com/safety_controllers/drawings/aes.pdf, pp. 159-175, date unknown.

BNS 33 Range, Magnetic safety sensors, Rectangular design, http://www.farnell.com/datasheets/36449.pdf, 3 pages, date unknown.

Series BNS-B20, Coded-Magnet Sensor Safety Door Handle, http://www.schmersalusa.com/catalog_pdfs/BNS_B20.pdf, 2 pages, date unknown.

Series BNS333, Coded-Magnet Sensors with Integral Safety Control Module, http://www.schmersalusa.com/machine_guarding/coded_magnet/drawings/bns333.pdf, 2 pages, date unknown.

Wikipedia, "Barker Code", Web article, last modified Aug. 2, 2008, 2 pages.

Wikipedia, "Kasami Code", Web article, last modified Jun. 11, 2008, 1 page.

Wikipedia, "Linear feedback shift register", Web article, last modified Nov. 11, 2008, 6 pages.

Wikipedia, "Golomb Ruler", Web article, last modified Nov. 4, 2008, 3 pages.

Wikipedia, "Costas Array", Web article, last modified Oct. 7, 2008, 4 pages.

Wikipedia, "Walsh Code", Web article, last modified Sep. 17, 2008, 2 pages.

Wikipedia, "Gold Code", Web article, last modified Jul. 27, 2008, 1 page.

Wikipedia, "Bitter Electromagnet", Web article, last modified Aug. 2011,1 page.

Pill-soo Kim, "A future cost trends of magnetizer systems in Korea", Industrial Electronics, Control, and Instrumentation, 1996, vol. 2, Aug. 5, 1996, pp. 991-996.

United States Office Action, dated Aug. 26, 2011, issued in counterpart U.S. Appl. No. 12/206,270.

United States Office Action, dated Mar. 12, 2012, issued in counterpart U.S. Appl. No. 12/206,270.

United States Office Action, dated Feb. 22, 2011, issued in counterpart U.S. Appl. No. 12/476,952.

United States Office Action, dated Oct. 12, 2011, issued in counterpart U.S. Appl. No. 12/476,952.

United States Office Action, dated Mar. 9, 2012, issued in counterpart U.S. Appl. No. 13/371,280.

International Search Report and Written Opinion, dated May 14, 2009, issued in related International Application No. PCT/US2009/038925.

International Search Report and Written Opinion, dated Jul. 13, 2010, issued in related International Application No. PCT/US2010/021612.

International Search Report and Written Opinion dated Jun. 1, 2009, issued in related International Application No. PCT/US2009/002027.

International Search Report and Written Opinion, dated Aug. 18, 2010, issued in related International Application No. PCT/US2010/036443.

International Search Report and Written Opinion, dated Apr. 8, 2011 issued in related International Application No. PCT/US2010/049410.

Atallah, K., Calverley, S.D., D. Howe, 2004, "Design, analysis and realisation of a high-performance magnetic gear", IEE Proc.-Electr. Power Appl., vol. 151, No. 2, Mar. 2004.

Atallah, K., Howe, D. 2001, "A Novel High-Performance Magnetic Gear", IEEE Transactions on Magnetics, vol. 37, No. 4, Jul. 2001, p. 2844-46.

Bassani, R., 2007, "Dynamic Stability of Passive Magnetic Bearings", Nonlinear Dynamics, V. 50, p. 161-68.

Boston Gear 221S-4, One-stage Helical Gearbox, http://www.bostongear.com/pdf/product_sections/200_series_helical.pdf, referenced Jun. 2010.

Charpentier et al., 2001, "Mechanical Behavior of Axially Magnetized Permanent-Magnet Gears", IEEE Transactions on Magnetics, vol. 37, No. 3, May 2001, p. 1110-17.

Chau et al., 2008, "Transient Analysis of Coaxial Magnetic Gears Using Finite Element Comodeling", Journal of Applied Physics, vol. 103.

Choi et al., 2010, "Optimization of Magnetization Directions in a 3-D Magnetic Structure", IEEE Transactions on Magnetics, vol. 46, No. 6, Jun. 2010, p. 1603-06.

Correlated Magnetics Research, 2009, Online Video, "Innovative Magnetics Research in Huntsville", http://www.youtube.com/watch?v=m4m81JjZCJo.

Correlated Magnetics Research, 2009, Online Video, "Non-Contact Attachment Utilizing Permanent Magnets", http://www.youtube.com/watch?v=3xUm25CNNgQ.

Correlated Magnetics Research, 2010, Company Website, http://www.correlatedmagnetics.com.

Furlani 1996, "Analysis and optimization of synchronous magnetic couplings", J. Appl. Phys., vol. 79, No. 8, p. 4692.

Furlani 2001, "Permanent Magnet and Electromechanical Devices", Academic Press, San Diego.

Furlani, E.P., 2000, "Analytical analysis of magnetically coupled multipole cylinders", J. Phys. D: Appl. Phys., vol. 33, No. 1, p. 28-33.

General Electric DP 2.7 Wind Turbine Gearbox, http://www.gedrivetrain.com/insideDP27.cfm, referenced Jun. 2010.

Ha et al., 2002, "Design and Characteristic Analysis of Non-Contact Magnet Gear for Conveyor by Using Permanent Magnet", Conf. Record of the 2002 IEEE Industry Applications Conference, p. 1922-27.

Huang et al., 2008, "Development of a Magnetic Planetary Gearbox", IEEE Transactions on Magnetics, vol. 44, No. 3, p. 403-12.

International Search Report and Written Opinion of the International Searching Authority issued in Application No. PCT/US12/61938 dated Feb. 26, 2013.

International Search Report and Written Opinion of the International Searching Authority issued in Application No. PCT/US2013/028095 dated May 13, 2013.

Jian et al., "Comparison of Coaxial Magnetic Gears With Different Topologies", IEEE Transactions on Magnetics, vol. 45, No. 10, Oct. 2009, p. 4526-29.

Jian, L., Chau, K.T., 2010, "A Coaxial Magnetic Gear With Halbach Permanent-Magnet Arrays", IEEE Transactions on Energy Conversion, vol. 25, No. 2, Jun. 2010, p. 319-28.

Jørgensen et al., "The Cycloid Permanent Magnetic Gear", IEEE Transactions on Industry Applications, vol. 44, No. 6, Nov./Dec. 2008, p. 1659-65.

(56) References Cited

OTHER PUBLICATIONS

Jørgensen et al., 2005, "Two dimensional model of a permanent magnet spur gear", Conf. Record of the 2005 IEEE Industry Applications Conference, p. 261-5.
Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.
Krasil'nikov et al., 2009, "Torque Determination for a Cylindrical Magnetic Clutch", Russian Engineering Research, vol. 29, No. 6, pp. 544-547.
Liu et al., 2009, "Design and Analysis of Interior-magnet Outer-rotor Concentric Magnetic Gears", Journal of Applied Physics, vol. 105.
Lorimer, W., Hartman, A., 1997, "Magnetization Pattern for Increased Coupling in Magnetic Clutches", IEEE Transactions on Magnetics, vol. 33, No. 5, Sep. 1997.
Mezani, S., Atallah, K., Howe, D. , 2006, "A high-performance axial-field magnetic gear", Journal of Applied Physics vol. 99.
Mi, "Magnetreater/Charger Model 580" Magnetic Instruments Inc. Product specification, May 4, 2009, http://web.archive.org/web/20090504064511/http://www.maginst.com/specifications/580_magnetreater.htm, 2 pages.
Neugart PLE-160, One-Stage Planetary Gearbox, http://www.neugartusa.com/ple_160_gb.pdf, referenced Jun. 2010.
Notice of Allowance issued in U.S. Appl. No. 13/471,189 dated Apr. 3, 2013.
Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.
United States Office Action issued in U.S. Appl. No. 13/104,393 dated Apr. 4, 2013.
United States Office Action issued in U.S. Appl. No. 13/236,413 dated Jun. 6, 2013.
United States Office Action issued in U.S. Appl. No. 13/374,074 dated Feb. 21, 2013.
United States Office Action issued in U.S. Appl. No. 13/470,994 dated Jan. 7, 2013.
United States Office Action issued in U.S. Appl. No. 13/529,520 dated Sep. 28, 2012.
United States Office Action issued in U.S. Appl. No. 13/530,893 dated Mar. 22, 2013.
United States Office Action issued in U.S. Appl. No. 13/855,519 dated Jul. 17, 2013.
C. Pompermaier, L. Sjoberg, and G. Nord, Design and Optimization of a Permanent Magnet Transverse Flux Machine, XXth International Conference on Electrical Machines, Sep. 2012, p. 606, IEEE Catalog No. CFP1290B-PRT, ISBN: 978-1-4673-0143-5.
V. Rudnev, An Objective Assessment of Magnetic Flux Concentrators, Heat Treating Progress, Nov./Dec. 2004, p. 19-23.
Kim, Pill Soo, Kim, Yong, Field and Thermal Modeling of Magnetizing Fixture by Impulse, Power Electronics and Drive Systems, 2003. The fifth conference on, Dec. 2003,1301-1306.

* cited by examiner

SYSTEM AND METHOD FOR DEMAGNETIZATION OF A MAGNETIC STRUCTURE REGION

CLAIM OF PRIORITY

This application claims the benefit U.S. Provisional Application Ser. No. 61/795,352 filed on Oct. 15, 2012. The contents of this document are incorporated by reference herein.

FIELD OF THE INVENTION

The present invention relates generally to a system and method for demagnetization of a magnetic structure region. More particularly, the present invention relates to demagnetization of a magnetic structure region by magnetically overwriting alternating polarity maxels having decreasing field strengths.

BACKGROUND OF THE INVENTION

The demagnetization or removal of a magnetic field may be accomplished in several ways as described at http://www.ndt-ed.org/EducationResources/CommunityCollege/MagParticle/Physics/Demagnetization.htm, on Oct. 12, 2012, which is incorporated by reference herein. One demagnetization approach is to heat a material above its Curie temperature to produce a random orientation of the magnetic domains, which demagnetizes the material. Another demagnetization approach is to subject the material to a reversing and decreasing magnetic field produced by driving a (de)magnetizer with a decreasing alternating current. This AC demagnetization process, shown in FIG. 1 (PRIOR ART), can be accomplished by pulling a component out and away from a coil with AC passing through it. The same can also be accomplished using an electromagnetic yoke with AC selected. Also, many stationary magnetic particle inspection units come with a demagnetization feature that slowly reduces the AC in a coil in which the component is placed. As can be seen in FIG. 1 (PRIOR ART), which depicts a demagnetization hysteresis curve 102, the current passing through a magnetizing coil decreases in accordance with an alternating current having a current curve 104. The demagnetizing field of the magnetizing coil corresponds to a flux curve 106 that corresponds to the current curve 104, where the alternating polarity H field that is produced by the coil results in a smaller and smaller B field being present in the material inside the coil. An alternative demagnetization approach is the subject of the present invention.

SUMMARY

A system and method for demagnetizing a region of a magnetic structure are described in the independent claims of the present application. Advantageous embodiments of the system and method have been described in the dependent claims of the present application.

In one aspect, the present invention provides a system for demagnetizing a region of a magnetic structure. The system comprises a pulsed magnetizer and at least one magnetizing coil. The at least one magnetizing coil receives a sequence of discrete currents with continually decreasing current values from the pulsed magnetizer and outputs a sequence of discrete magnetizing fields with continually decreasing field strengths to overwrite and at least partly demagnetize the region of the magnetic structure. The at least one magnetizing coil is located adjacent to the region of the magnetic structure.

In another aspect, the present invention provides a method for demagnetizing a region of a magnetic structure. The method comprises: (a) generating, by a pulsed magnetizer, a sequence of discrete currents with continually decreasing current values; (b) receiving, by at least one magnetizing coil, the sequence of discrete currents with continually decreasing current values; and (3) outputting, by the at least one magnetizing coil, a sequence of discrete magnetizing fields with continually decreasing field strengths to overwrite and at least partly demagnetize the region of the magnetic structure. The at least one magnetizing coil is located adjacent to the region of the magnetic structure.

Additional aspects of the invention will be set forth, in part, in the detailed description, figures and any claims which follow, and in part will be derived from the detailed description, or can be learned by practice of the invention. It is to be understood that both the foregoing general description and the following detailed description are exemplary and explanatory only and are not restrictive of the invention as disclosed.

BRIEF DESCRIPTION OF THE DRAWINGS

A more complete understanding of the present invention may be obtained by reference to the following detailed description when taken in conjunction with the accompanying drawings wherein.

DETAILED DESCRIPTION OF THE INVENTION

Figure 2:
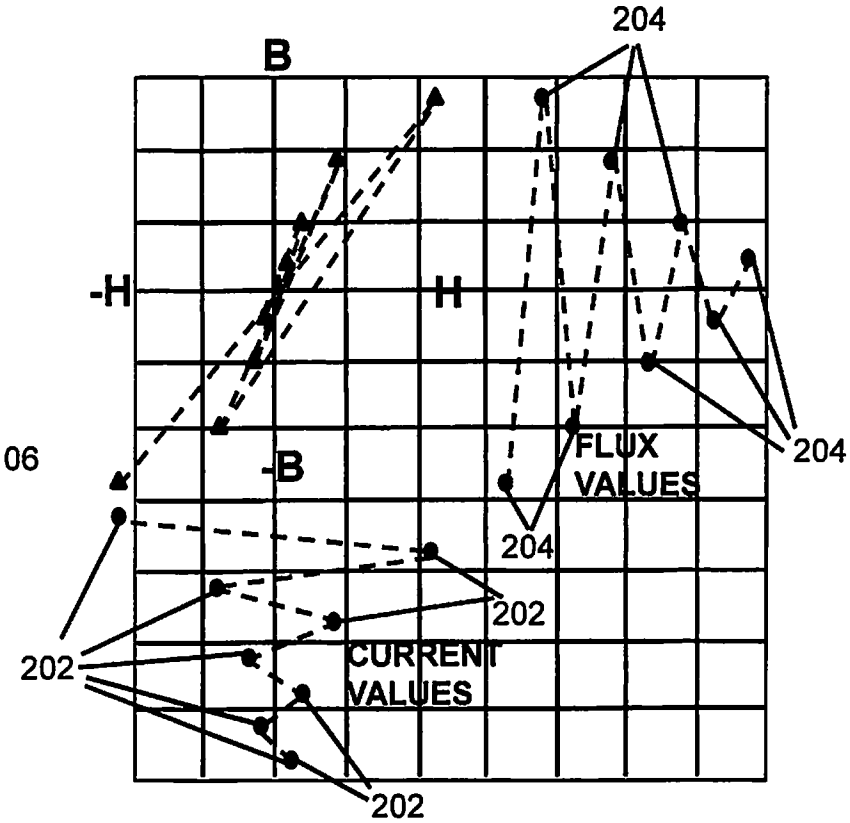
FIG. 2 is a graph used to help explain a new demagnetization process for demagnetizing a magnetic structure in accordance with an embodiment of the present invention.

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

The present invention pertains to a system and method for demagnetization of a magnetic structure region. Certain described embodiments may relate, by way of example but not limitation, to systems and/or apparatuses comprising magnetic structures, methods for using magnetic structures, magnetic structures produced via magnetic printing, magnetic structures comprising arrays of discrete magnetic elements, combinations thereof, and so forth. Example realizations for such embodiments may be facilitated, at least in part, by the use of an emerging, revolutionary technology that may be termed correlated magnetics. This revolutionary technology referred to herein as correlated magnetics was first fully described and enabled in the co-assigned U.S. Pat. No. 7,800,471 issued on Sep. 21, 2010, and entitled "A Field Emission System and Method". The contents of this document are hereby incorporated herein by reference. A second generation of a correlated magnetic technology is described and enabled in the co-assigned U.S. Pat. No. 7,868,721 issued on Jan. 11, 2011, and entitled "A Field Emission System and Method". The contents of this document are hereby incorporated herein by reference. A third generation of a correlated magnetic technology is described and enabled in the co-assigned U.S. patent application Ser. No. 12/476,952 filed on Jun. 2, 2009, and entitled "A Field Emission System and Method". The contents of this document are hereby incorporated herein by reference. Another technology known as correlated inductance, which is related to correlated magnetics, has been described and enabled in the co-assigned U.S. Pat. No. 8,115,581 issued on Feb. 14, 2012, and entitled "A System and Method for Producing an Electric Pulse". The contents of this document are hereby incorporated by reference.

Material presented herein may relate to and/or be implemented in conjunction with multilevel correlated magnetic systems and methods for producing a multilevel correlated magnetic system such as described in U.S. Pat. No. 7,982,568 issued Jul. 19, 2011 which is all incorporated herein by reference in its entirety. Material presented herein may relate to and/or be implemented in conjunction with energy generation systems and methods such as described in U.S. patent application Ser. No. 12/895,589 filed Sep. 30, 2010, which is all incorporated herein by reference in its entirety. Such systems and methods described in U.S. Pat. No. 7,681,256 issued Mar. 23, 2010, U.S. Pat. No. 7,750,781 issued Jul. 6, 2010, U.S. Pat. No. 7,755,462 issued Jul. 13, 2010, U.S. Pat. No. 7,812,698 issued Oct. 12, 2010, U.S. Pat. Nos. 7,817,002, 7,817,003, 7,817,004, 7,817,005, and 7,817,006 issued Oct. 19, 2010, U.S. Pat. No. 7,821,367 issued Oct. 26, 2010, U.S. Pat. Nos. 7,823,300 and 7,824,083 issued Nov. 2, 2011, U.S. Pat. No. 7,834,729 issued Nov. 16, 2011, U.S. Pat. No. 7,839,247 issued Nov. 23, 2010, U.S. Pat. Nos. 7,843,295, 7,843,296, and 7,843,297 issued Nov. 30, 2010, U.S. Pat. No. 7,893,803 issued Feb. 22, 2011, U.S. Pat. Nos. 7,956,711 and 7,956,712 issued Jun. 7, 2011, U.S. Pat. Nos. 7,958,575, 7,961,068 and 7,961,069 issued Jun. 14, 2011, U.S. Pat. No. 7,963,818 issued Jun. 21, 2011, and U.S. Pat. Nos. 8,015,752 and 8,016,330 issued Sep. 13, 2011, and U.S. Pat. No. 8,035,260 issued Oct. 11, 2011 are all incorporated by reference herein in their entirety.

Various methods for printing maxels are described in U.S. Parent application Ser. No. 13/240,355, field Sep. 22, 2011 and titled Magnetic Structure Production, which is incorporated by reference herein it its entirety.

In accordance with the present invention, a region of a magnetic structure is demagnetized (or erased) by successive overwriting of the region with magnetic sources having alternating polarities and decreasing field strengths. More specifically, the magnetic field sources, which are often called maxels, are produced using a pulsed magnetizer where a very short current pulse is passed through a magnetizing coil located adjacent to a location on the surface of a magnetizable material. Each maxel has a size, shape, depth, polarity, field strength, angle relative to the magnetization surface, and various other maxel characteristics that are in accordance with material characteristics such as material type (e.g., NIB), grade, thickness, shape (e.g., flat), etc., magnetizing coil characteristics such as metal type, layer thickness, number of turns, aperture width, coil width, coil shape, aperture shape, etc., and magnetizing characteristics such as the amount of current passed through the coil, and the direction of the current through the coil, distance between the coil and the surface, angle of the coil relative to the surface, etc., where one skilled in the art will understand that any of these magnetizing coil characteristics and/or magnetizing characteristics can be varied to effect demagnetization in accordance with the invention. As such, one or more magnetizer coils having the same or different magnetizing coil characteristics can be used with the same or different magnetizing characteristics to overwrite and demagnetize one or more regions on one or more magnetic structures.

Figure 1:
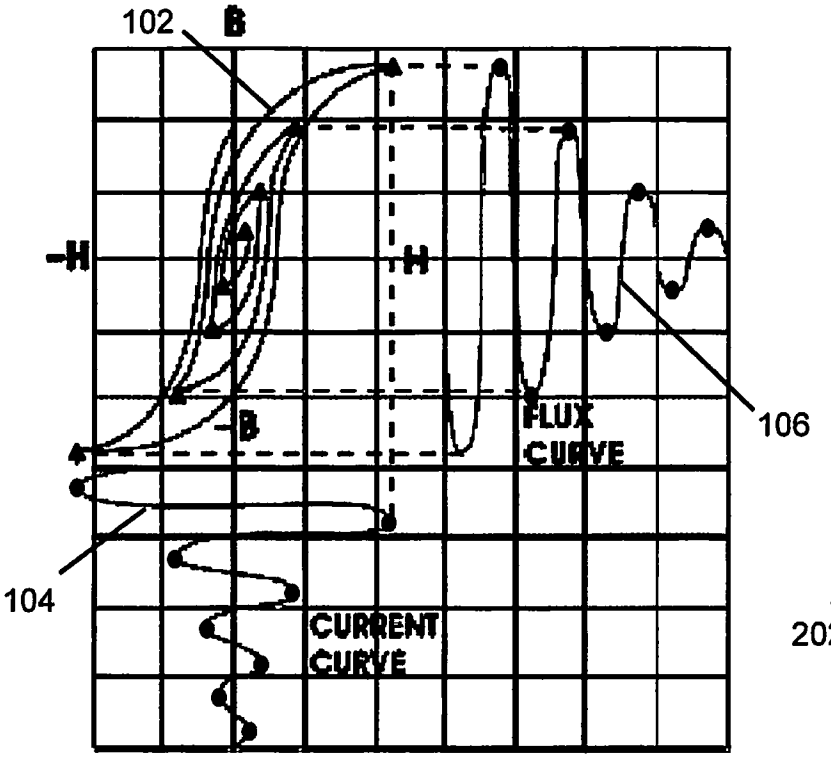
FIG. 1 (Prior Art)
FIG. 1 (PRIOR ART) is a graph used to help explain a traditional AC demagnetization process for demagnetizing a magnetic structure.

FIG. 2 depicts exemplary discreet current values 202 of current used to drive a magnetizer coil in order to produce (or write) overwrite alternating polarity maxels at a given location on a material, where each discreet current value 202 has a corresponding discreet flux value 204 of magnetic flux produced by the magnetizer coil. As shown, the current values 202 used to drive the magnetizer coil change polarity and decrease with each printed maxel to produce a sequence of alternating polarity maxels with decreased field strength in order to demagnetize the location on the material. The discrete current values 202 and flux values 204, for example, correspond to the peak current and peak flux values of the current and flux curves 104 and 106 of FIG. 1. However, the discrete current values 202 can decrease in accordance with some other desired decrement pattern such as a uniform decrement pattern. Generally, the starting discrete current value 202 of a demagnetization process can be selected based on the field strength of the region of the magnetic structure as determined prior to demagnetization. For example, a measurement of the field to be erased could be made, and a current value 202 could be selected such that the starting demagnetizing magnetic field would be of opposite polarity of the field being erased and somewhat lower in field strength. However, an alternate approach would be to select a starting current value 202 based on material characteristics that will result in a near saturating field. However, if only partial demagnetization is desired, the starting demagnetizing field may be selected that is substantially lower than the field strength of the region of the magnetic structure prior to demagnetization.

Because the printing of each maxel is substantially a discreet event as opposed to demagnetization using a continuous alternating current, all sorts of combinations are possible for demagnetizing a region on a magnetic structure including use of multiple print heads to demagnetize one or more regions on one or more magnetic structures, where characteristics of a given print head and the use of such print head can be controlled to control the demagnetization process. For example, one or more print heads can be used to demagnetize a region on a magnetic structure, where the location of at least one print head is fixed. Alternatively, one or more movable print heads may be used. Combinations of different print head sizes (e.g., aperture diameters), maxel shapes, maxel depths, and the like can be used. Many patterning choices are available such as maxel print order, the amount of overlapping of maxels (or spatial density), the spacing between maxels, etc. Moreover, instead of alternating polarity with each overwriting maxel, multiple maxels of the same polarity may overwrite successively. In other words, a region may be overwritten one or more times with a magnetizing field having the same polarity before being overwritten one or more times with a magnetizing field having the opposite polarity. Generally, one skilled in the art will recognize that all sorts of variations of the invention are possible.

Figure 3A:
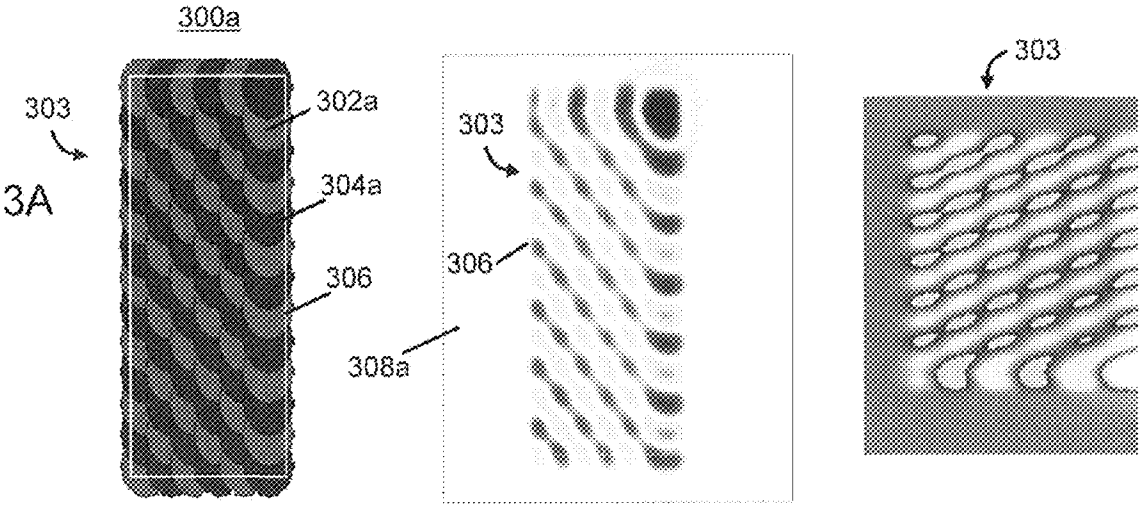
FIGS. 3A-3D illustrate an exemplary demagnetization process for demagnetizing a region (i.e., outer edge or outer perimeter) on a magnetic structure in accordance with an embodiment of the present invention.
Figure 3B:
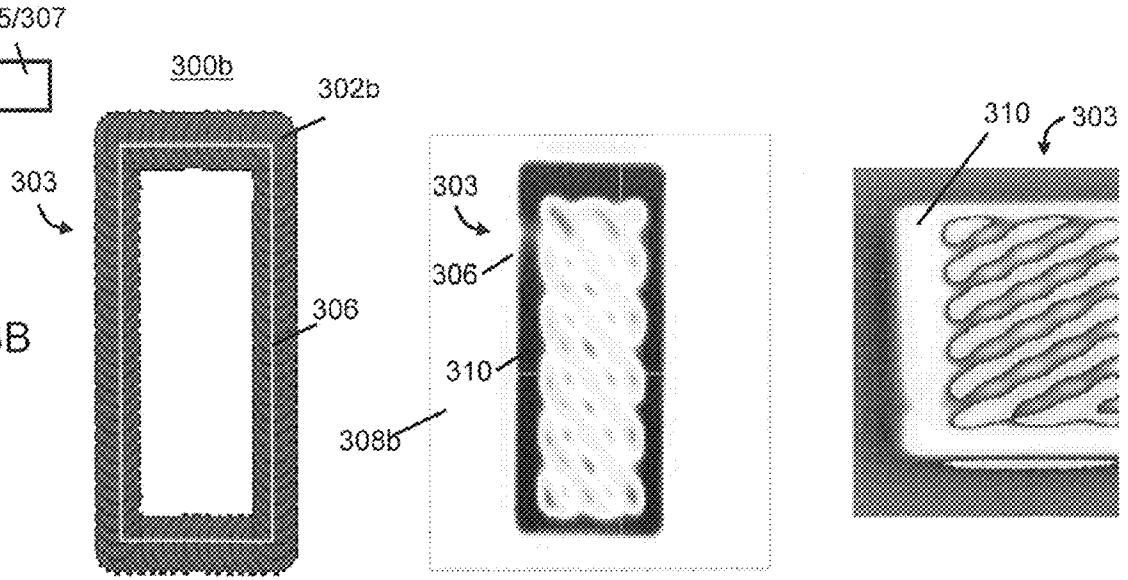
Figure 3C:
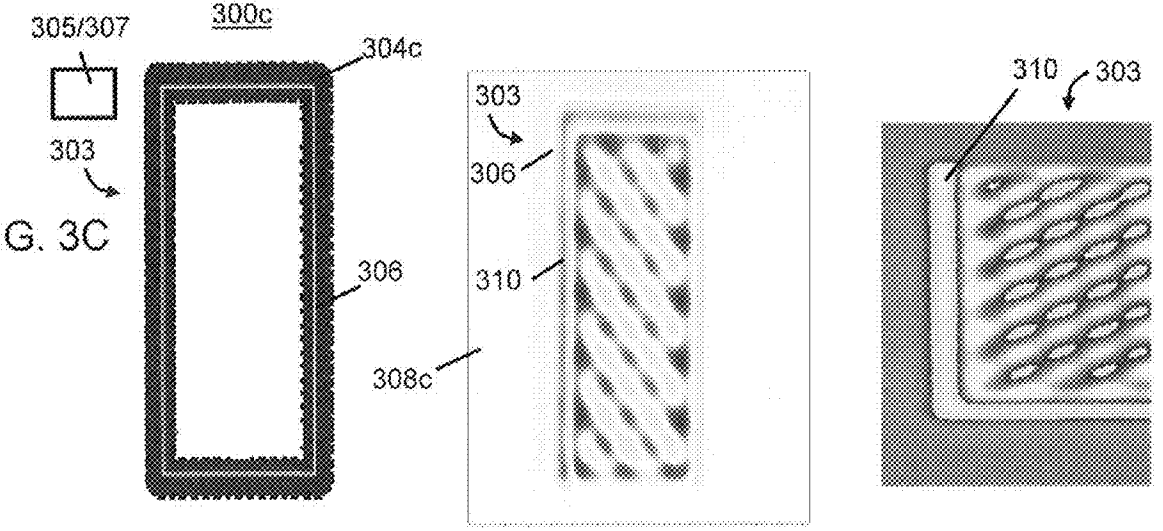
Figure 3D:
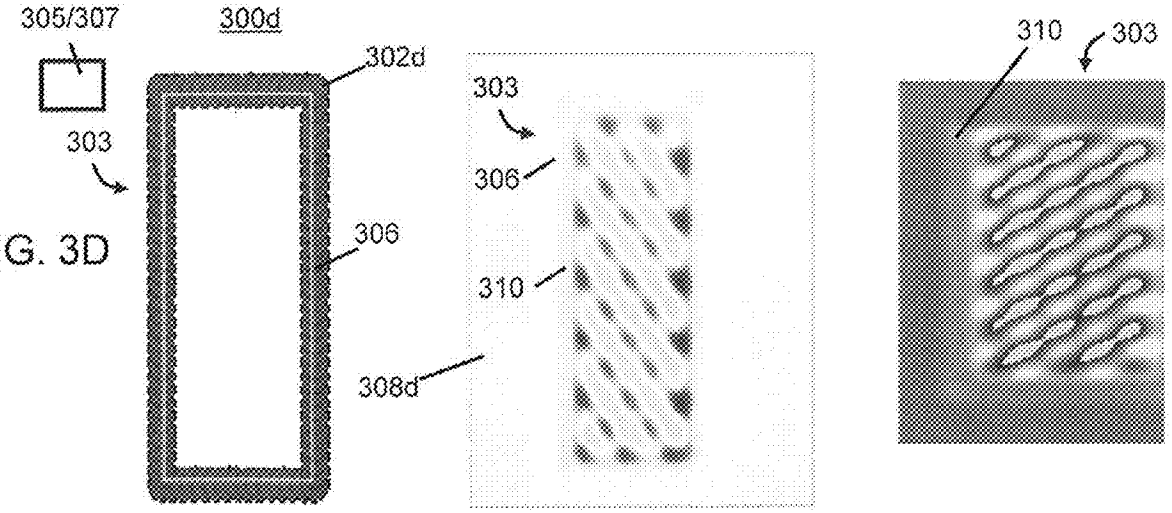

FIGS. 3A through 3D are provided to illustrate an exemplary demagnetization process for demagnetizing a region 306 on a magnetic structure 303 corresponding to its outer boundary (i.e., outer edge or outer perimeter). Referring to FIG. 3A, a first maxel pattern 300*a* of first polarity maxels 302*a* and second polarity maxels 304*a* have been printed onto a magnetizable material 303 having an outer boundary 306. The maxels 302*a* and 304*a* have been printed in columns from the bottom of the magnetizable material 303 to the top of the magnetizable material 303 and from the left side to the right. As such, the first maxel printed is in the lower left corner and the last maxel printed is in the upper right corner. A field scan 308*a* shows the resulting magnetic field, where the outer boundary 306 of the magnetizable material 303 is shown. FIG. 3B shows a second maxel pattern 300*b* comprising overlapping first polarity maxels 302*b* having a first field strength that are printed by magnetizing coils 305 (and a pulsed magnetizer 307) along the outer boundary 306, which corresponds to a demagnetization region 310 on the magnetizable material 303. The resulting field scan 308*b* shows the outer boundary 306 and demagnetization region 310 of the magnetizable material 303. In FIG. 3C, a third maxel pattern 300*c* comprising overlapping second polarity maxels 304*c* having a second field strength less than the first field strength that are printed by magnetizing coils 305 (and a pulsed magnetizer 307) along the outer boundary 306, which corresponds to a demagnetization region 310*c* on the magnetizable material 303. As seen in the field scan 308*c* of FIG. 3C, the demagnetization region 310*c* is becoming more and more demagnetized on the magnetizable material 303. In FIG. 3D, a fourth maxel pattern 300*d* comprising overlapping first polarity maxels 302*d* having a third field strength that are printed by magnetizing coils 305 (and a pulsed magnetizer 307) along the outer boundary 306, which corresponds to a demagnetization region 310*c* on the magnetizable material 303. As seen in the field scan 308*d* of FIG. 3D, the demagnetization region 310 is substantially demagnetized on the magnetizable material 303.

Figure 4:
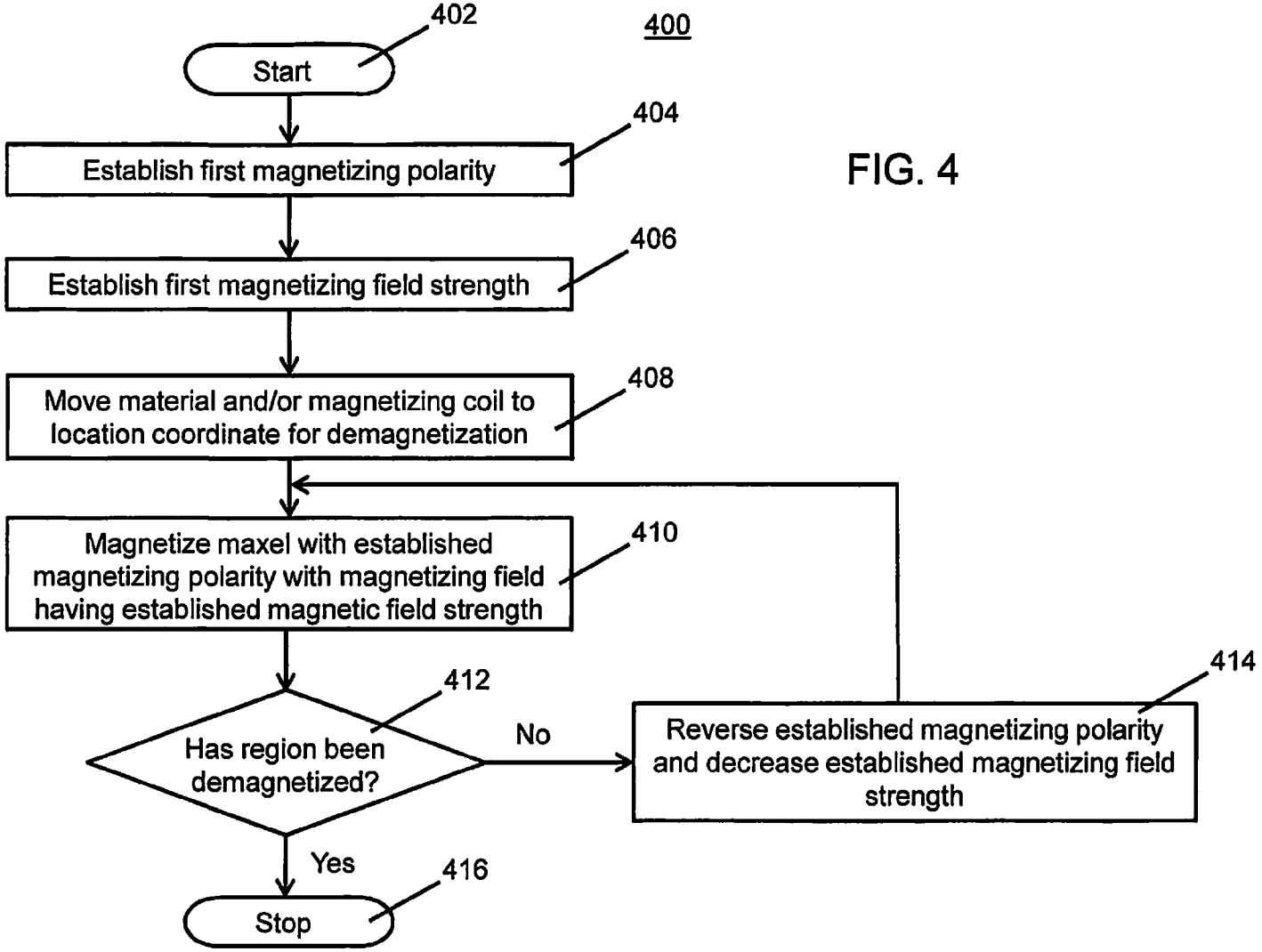
FIG. 4 is a flowchart illustrating an exemplary demagnetization method in accordance with an embodiment of the present invention.

In accordance with one method 400 shown in FIG. 4, a maxel can be demagnetized by successively printing maxels having reversing polarity and decreasing field strength at the same location. At step 402, the demagnetizing process is started. At step 404, establish first magnetizing polarity. At step 406, establish first magnetizing field strength. At step 408, move material and/or magnetizing coil to location coordinate for demagnetization. At step 410, magnetize maxel with established magnetizing field having established magnetic field strength. At step 412, determine if region has been demagnetized. If result of step 412 is no, then at step 414 reverse established magnetizing polarity and decrease established magnetizing field strength then return to step 410. If result of step 412 is yes, then at step 416 stop the demagnetizing process.

Figure 5:
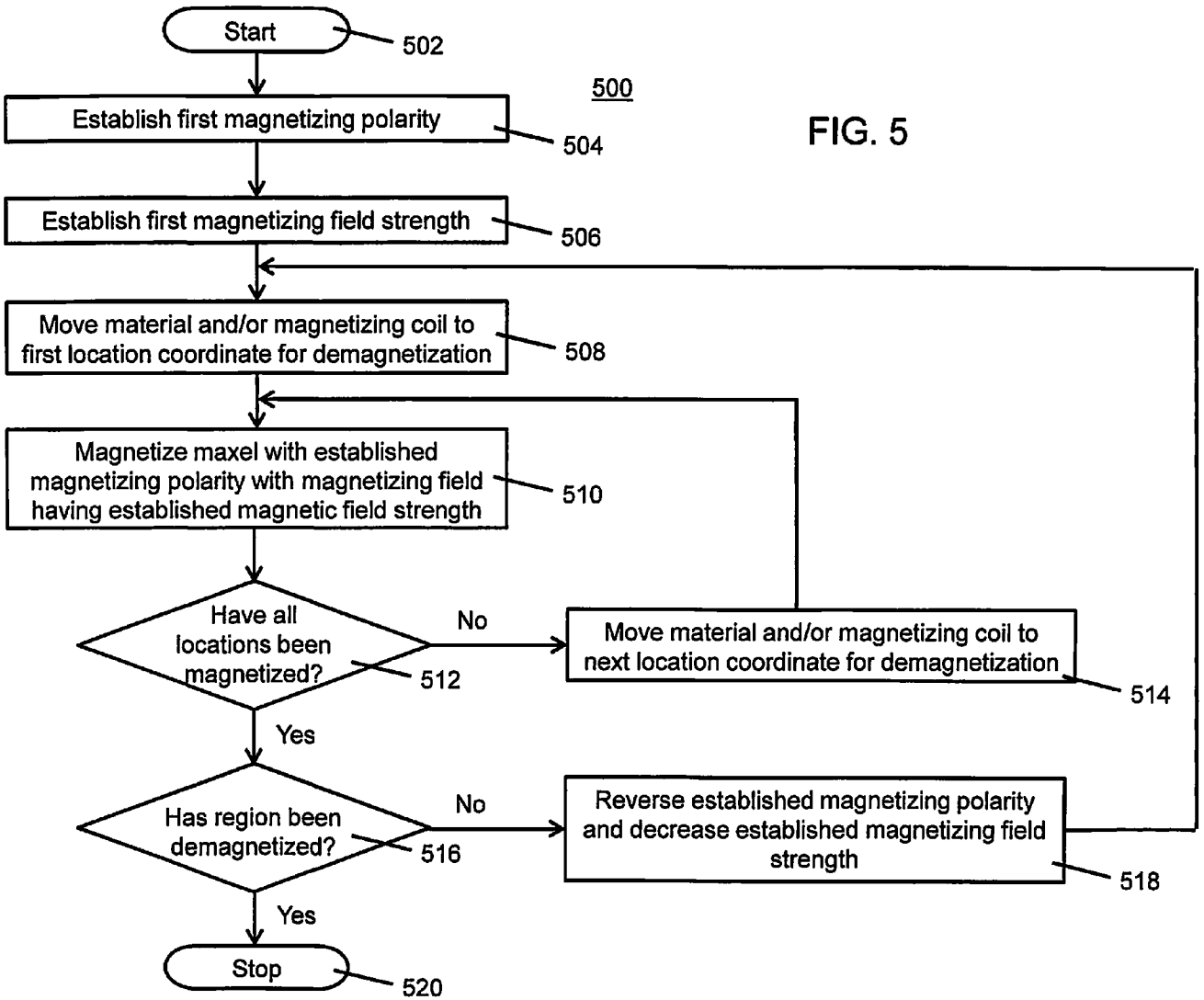
FIG. 5 is a flowchart illustrating another exemplary demagnetization method in accordance with an embodiment of the present invention.

In accordance with another demagnetizing method 500 shown in FIG. 5, the demagnetization of a region can involve magnetization of an entire region by printing a plurality of maxels of the same polarity and field strength over the region, rewriting the region with opposite polarity maxels having a lesser field strength, and repeating the previous two steps until the region is demagnetized. At step 502, the demagnetizing process is started. At step 504, establish first magnetizing polarity. At step 506, establish first magnetizing field strength. At step 508, move material and/or magnetizing coil to first location coordinate for demagnetization. At step 510, magnetize maxel with established magnetizing polarity with magnetizing field having established magnetic field strength. At step 512, determine if all locations have been demagnetized. If result of step 512 is no, then at step 514 move material and/or magnetizing coil to next location coordinate for demagnetization and then return to step 510. If result of step 512 is yes, then at step 516 determine if region has been demagnetized. If result of step 516 is no, then at step 518 reverse established magnetizing polarity and decrease established magnetizing field strength then return to step 508. If result of step 516 is yes, then at step 520 stop the demagnetizing process.

Figure 6:
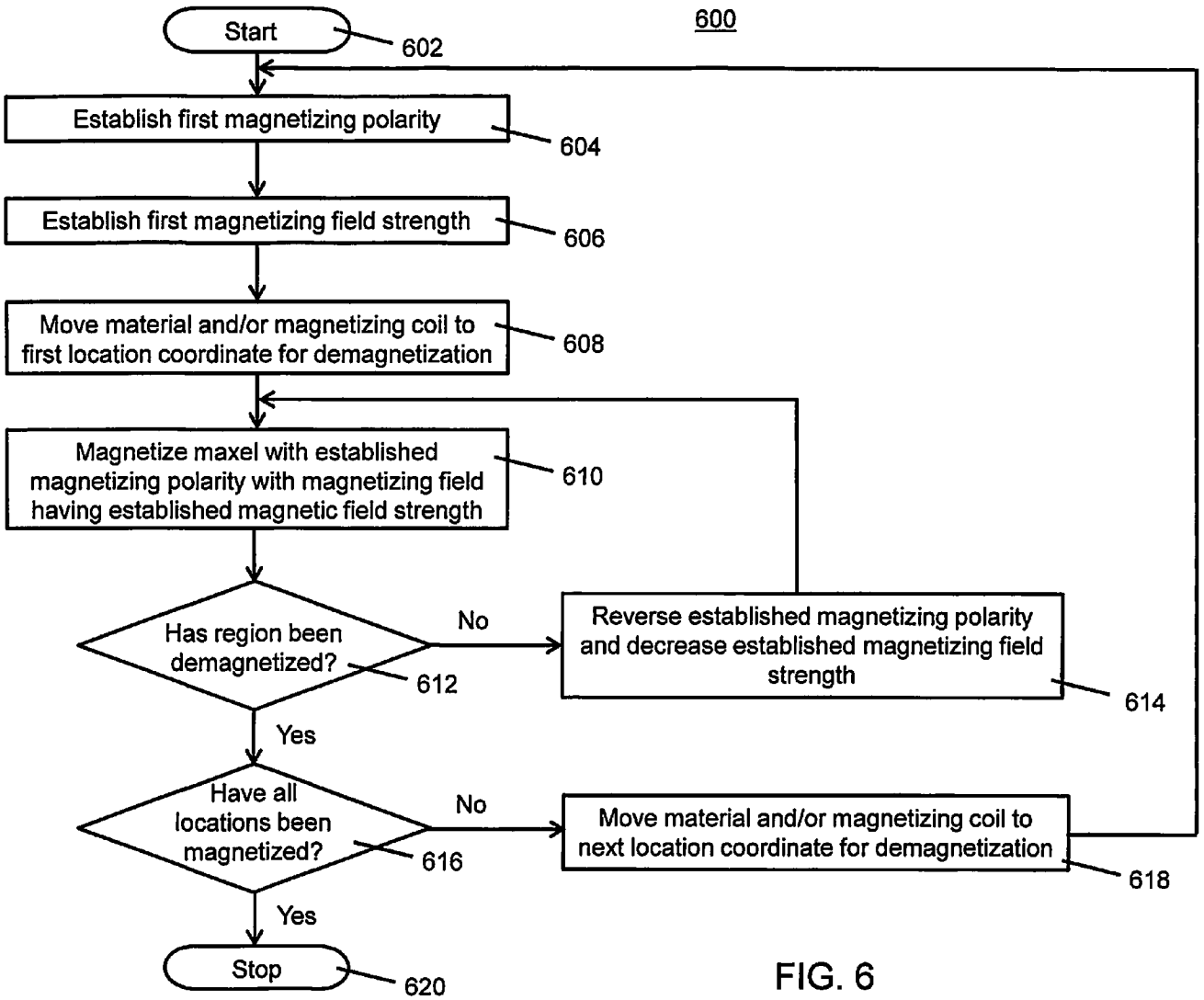
FIG. 6 is a flowchart illustrating yet another exemplary demagnetization method in accordance with an embodiment of the present invention.

Yet another demagnetizing method 600 is shown in FIG. 6, this demagnetizing method 600 involves demagnetizing a region by demagnetizing each maxel location one at a time. At step 602, the demagnetizing process is started. At step 604, establish first magnetizing polarity. At step 606, establish first magnetizing field strength. At step 608, move material and/or magnetizing coil to first location coordinate for demagnetization. At step 610, magnetize maxel with established magnetizing polarity with magnetizing field having established magnetic field strength. At step 612, determine if region has been demagnetized. If result of step 612 is no, then at step 614 reverse established magnetizing polarity and decrease established magnetizing field strength then return to step 610. If result of step 612 is yes, then at step 616 determine if all locations have been demagnetized. If result of step 616 is no, then at step 618 move material and/or magnetizing coil to next location coordinate for demagnetization and then return to step 604. If result of step 616 is yes, then at step 620 stop the demagnetizing process.

In accordance with the invention, a material can be demagnetized on one side and then demagnetized on the other, or both sides may be demagnetized at the same time. Under another arrangement, only one side may be demagnetized. The depth of demagnetization may or may not correspond to the depth that a material was previously magnetized. Demagnetization can involve printing maxels of alternating polarity with a different magnetization direction then a material was originally magnetized.

In accordance with the invention, maxels of a given polarity may overwrite a given region a plurality of times before the polarity of the overwriting maxels is changed. The maxels of the given polarity may be printed by the same print head or multiple print heads as necessary to efficiently overwrite the region.

A region to be demagnetized may correspond to an outer boundary of a material such as depicted in FIGS. 3A-3D, which might be done to limit side interaction between two magnetic structures in which case the width of the demagnetized region can be selected to achieve a desired minimum attractive force between the two structures. A region may be internal to the structure.

More generally, demagnetization of a region in accordance with the invention does not have to be complete demagnetization. Instead, the demagnetization process may be used to partially magnetize so as to lower the field strength of a given region. As such, the present invention enables a way of weakening a maxel or a group of maxels.

Demagnetization in accordance with the invention can enable conveyance of information, where a sensor can detect demagnetized regions, which can be in accordance with a predefined pattern corresponding to the information.

While particular embodiments of the invention have been described, it will be understood, however, that the invention is not limited thereto, since modifications may be made by those skilled in the art, particularly in light of the foregoing teachings.

The invention claimed is:

1. A system for demagnetizing a region of a magnetic structure, the system comprising:

a pulsed magnetizer; and at least one magnetizing coil that receives a sequence of discrete current pulses with continually decreasing current values from the pulsed magnetizer and outputs a sequence of discrete magnetizing fields with continually decreasing field strengths to at least partly demagnetize the region of the magnetic structure, wherein the region is one of a plurality of regions of the magnetic structure, wherein the magnetic structure comprises a permanent magnet material previously magnetized such that a plurality of magnetic sources are exposed on a surface of said magnetic structure including at least one first magnetic source having a first polarity and at least one second magnetic source having a second polarity opposite said first polarity, wherein the sequence of discrete current pulses and the sequence of discrete magnetizing fields correspond to a sequence of discrete magnetizing events, and wherein the at least one magnetizing coil is located adjacent to the region on the surface of the magnetic structure during said sequence of discrete magnetizing events, and wherein after said region is at least partly demagnetized at least one other region of said plurality of regions of said magnetic structure remains as previously magnetized.

2. The system of claim 1, wherein the at least one magnetizing coil receives the sequence of discrete current pulses with continually decreasing current values from the pulsed magnetizer and outputs the sequence of discrete magnetizing fields with the continually decreasing field strengths and alternating polarities to at least partly demagnetize the region of the magnetic structure.

3. The system of claim 1, wherein the at least one magnetizing coil receives the sequence of discrete current pulses with continually decreasing current values from the pulsed magnetizer and outputs a first portion of the sequence of discrete magnetizing fields with the continually decreasing field strengths and a first polarity and then outputs a second portion of the sequence of discrete magnetizing fields with the continually decreasing field strengths and a second polarity to overwrite and at least partly demagnetize the region of the magnetic structure.

4. The system of claim 1, wherein the first magnetic source comprises at least one maxel having the first polarity.

5. The system of claim 4, wherein each maxel has a size, shape, depth, polarity, field strength, and angle relative to the surface of the magnetic structure.

6. The system of claim 1, wherein each magnetizing coil has a metal type, layer thickness, number of turns, aperture width, coil width, coil shape, and aperture shape.

7. The system of claim 1, wherein the continually decreasing field strengths decrease with a predetermined decrement pattern.

8. The system of claim 1, wherein the continually decreasing field strengths have a starting field strength selected based on a field strength of the region of the magnetic structure as determined prior to demagnetization.

9. The system of claim 8, wherein the starting field strength is lower than the field strength of the region of the magnetic structure as determined prior to demagnetization.

10. The system of claim 1, wherein the continually decreasing field strengths have a starting field strength selected based on characteristics of the permanent magnet material.

11. The system of claim 1, wherein the at least one magnetizing coil is at least one movable magnetizing coil.

12. A method for demagnetizing a region of a magnetic structure, the method comprising:

generating, by a pulsed magnetizer, a sequence of discrete current pulses with continually decreasing current values;

receiving, by at least one magnetizing coil, the sequence of discrete current pulses with continually decreasing current values; and outputting, by the at least one magnetizing coil, a sequence of discrete magnetizing fields with continually decreasing field strengths to at least partly demagnetize the region of the magnetic structure, wherein the region is one of a plurality of regions of the magnetic structure, wherein the magnetic structure comprises a permanent magnet material previously magnetized such that a plurality of magnetic sources are exposed on a surface of said magnetic structure including at least one first magnetic source having a first polarity and at least one second magnetic source having a second polarity opposite said first polarity, wherein the sequence of discrete current pulses and the sequence of discrete magnetizing fields correspond to a sequence of discrete magnetizing events, and wherein the at least one magnetizing coil is located adjacent to the region on the surface of the magnetic structure during said sequence of discrete magnetizing events, and wherein after said region is at least partly demagnetized at least one other region of said plurality of regions of said magnetic structure remains as previously magnetized.

13. The method of claim 12, wherein the at least one magnetizing coil receives the sequence of discrete current pulses with continually decreasing current values from the pulsed magnetizer and outputs the sequence of discrete magnetizing fields with the continually decreasing field strengths and alternating polarities to at least partly demagnetize the region of the magnetic structure.

14. The method of claim 12, wherein the at least one magnetizing coil receives the sequence of discrete current pulses with continually decreasing current values from the pulsed magnetizer and outputs a first portion of the sequence of discrete magnetizing fields with the continually decreasing field strengths and a first polarity and then outputs a second portion of the sequence of discrete magnetizing fields with the continually decreasing field strengths and a second polarity to overwrite and at least partly demagnetize the region of the magnetic structure.

15. The method of claim 12, wherein the first magnetic source comprises at least one maxel having a first polarity.

16. The method of claim 15, wherein each maxel has a size, shape, depth, polarity, field strength, and angle relative to the surface of the magnetic structure.

17. The method of claim 12, wherein each magnetizing coil has a metal type, layer thickness, number of turns, aperture width, coil width, coil shape, and aperture shape.

18. The method of claim 12, wherein the continually decreasing field strengths decrease with a predetermined decrement pattern.

19. The method of claim 12, wherein the continually decreasing field strengths have a starting field strength selected based on a field strength of the region of the magnetic structure as determined prior to demagnetization.

20. The method of claim 19, wherein the starting field strength is lower than the field strength of the region of the magnetic structure as determined prior to demagnetization.

21. The method of claim 12, wherein the continually decreasing field strengths have a starting field strength selected based on characteristics of the permanent magnet material.

22. The method of claim 12, wherein the at least one magnetizing coil is at least one movable magnetizing coil.

* * * * *